US010594052B2

(12) United States Patent
Tarulli et al.

(10) Patent No.: US 10,594,052 B2
(45) Date of Patent: Mar. 17, 2020

(54) SMT BOX RECEPTACLE WITH RELEASE LEVERS

(71) Applicant: ZIERICK MANUFACTURING CORPORATION, Mt. Kisco, NY (US)

(72) Inventors: Raffaele Tarulli, New York, NY (US); Frederick Michael Ackerman, Nanuet, NY (US)

(73) Assignee: Zierick Manufacturing Corporation, Mt. Kisco, NY (US)

( * ) Notice: Subject to any disclaimer, the term of this patent is extended or adjusted under 35 U.S.C. 154(b) by 0 days.

(21) Appl. No.: 16/182,835

(22) Filed: Nov. 7, 2018

(65) Prior Publication Data

US 2019/0140370 A1 May 9, 2019

Related U.S. Application Data

(60) Provisional application No. 62/582,573, filed on Nov. 7, 2017.

(51) Int. Cl.

| | |
|---|---|
| ***H01R 4/48*** | (2006.01) |
| ***H01R 12/75*** | (2011.01) |
| ***H01R 12/57*** | (2011.01) |
| ***H01R 12/53*** | (2011.01) |
| *H01R 12/51* | (2011.01) |
| *H01R 12/71* | (2011.01) |

(52) U.S. Cl.

CPC ..... *H01R 4/4836* (2013.01); *H01R 12/53* (2013.01); *H01R 12/57* (2013.01); *H01R 12/75* (2013.01); *H01R 12/515* (2013.01); *H01R 12/718* (2013.01)

(58) Field of Classification Search

CPC ..... H01R 4/4845; H01R 4/4836; H01R 4/48; H01R 4/4818

USPC ..... 439/834

See application file for complete search history.

(56) References Cited

U.S. PATENT DOCUMENTS

| | | | | |
|---|---|---|---|---|
| 4,468,073 A * | 8/1984 | Machcinski | ..... | H01R 12/88 439/266 |
| 4,952,178 A * | 8/1990 | Beer | ..... | H01R 13/114 439/842 |
| 4,981,432 A * | 1/1991 | Kikuchi | ..... | H01R 12/79 439/417 |
| 5,083,947 A * | 1/1992 | Dominique | ..... | H01R 4/489 439/268 |

(Continued)

FOREIGN PATENT DOCUMENTS

| | | |
|---|---|---|
| DE | 102011015968 | 10/2012 |
| KR | 20160029431 | 3/2016 |

*Primary Examiner* — Tulsidas C Patel
*Assistant Examiner* — Peter G Leigh
(74) *Attorney, Agent, or Firm* — Myron Greenspan; Lackenbach Siegel LLP

(57) ABSTRACT

A surface mount wire receptacle or connector includes an elongate flat base for surface mounting on a PCB. A cylindrical enclosure has spaced side wall portions at the upstream end of the base. A pair of resilient spring fingers extend from the side wall portions inwardly towards the axis. An actuating tab is provided on each spring finger to form cantilevers extending across the axis and beyond a cooperating spring finger and having a free end accessible to a user for application of generally opposing inwardly directed forces towards the axis to separate the free ends of the spring fingers when the actuating tabs are squeezed inwardly to release any captured wire.

20 Claims, 6 Drawing Sheets

(56) References Cited

U.S. PATENT DOCUMENTS 5,494,456 A * 2/1996 Kozel ..... H01R 4/4827 439/439
5,709,574 A * 1/1998 Bianca ..... H01R 12/57 439/83
6,280,230 B1 * 8/2001 Takase ..... H01R 4/245 439/397
6,743,061 B2 * 6/2004 Jaegerskuepper ... H01R 4/4818 439/834
7,357,651 B2 * 4/2008 Minoura ..... H01R 13/111 439/82
7,384,319 B2 * 6/2008 Kirstein ..... H01R 4/4818 439/439
7,513,793 B2 * 4/2009 Horst ..... H01R 4/4818 439/427
7,581,965 B1 * 9/2009 Upasani ..... H05K 3/32 439/82
7,952,457 B2 * 5/2011 Yamaguchi ..... H01F 27/306 336/196
8,591,271 B2 * 11/2013 Bies ..... H01R 4/4836 439/725
8,862,703 B2 10/2014 Quintard
8,968,022 B2 3/2015 Mostoller et al.
9,130,285 B2 * 9/2015 Scanzillo ..... H01R 4/4818
9,306,297 B2 * 4/2016 Bishop ..... H01R 12/515
9,306,301 B2 * 4/2016 Shimoji ..... H01R 12/53
9,472,871 B2 10/2016 Lin et al.
9,484,639 B1 11/2016 Chen
9,548,564 B2 1/2017 Wu et al.
9,711,876 B2 * 7/2017 Feye-Hohmann ... H01R 4/4836
9,735,479 B2 * 8/2017 Chen ..... H01R 4/48
9,799,968 B2 * 10/2017 Lin ..... H01R 4/48
2008/0153327 A1 * 6/2008 Weber ..... H01R 4/4818 439/83
2017/0033499 A1 2/2017 Fu et al.
2017/0062961 A1 * 3/2017 Fu ..... H01R 4/4827

* cited by examiner

SURFACE MOUNT
TOP-ENTRY ORIENTATION

SMT BOX RECEPTACLE WITH RELEASE LEVERS

BACKGROUND OF THE INVENTION

1. Field of the Invention

The present application generally relates to electrical connectors and, more specifically, to surface mount technology (SMT) box receptacle or connector with release tabs used to releasably connect an insulated wire to a component, such as a printed circuit board (PCB).

2. Description of the Prior Art

A number of SMT connectors have been used for forming connections between an insulated wire and electronic components.

One popular and commonly used SMT connector is a box connector stamped from sheet metal and formed into a contact frame provided with a channel formed by two spaced side walls and a base for the purpose of physically securing and providing electrical contact with a conductor. This is achieved by using leaf springs, resilient fingers or contact tines having free edges that form a conductor insertion region that tapers in the direction of a clamping point formed by the free edges. While the leaf springs or spring fingers can be readily spread apart to receive a wire having a diameter greater than the spacing or gap between the free edges of the relaxed spring finger, removal of such clamped wire is sometimes difficult because the free edges of the leaf spring fingers generate a significant amount of friction in the reverse or removal direction that must be overcome to remove the wire from the connector. The greater the biasing forces acting against the wire the greater the force needed to remove the wire. In some instances, the forces are so significant that damage can be caused to the wire itself or to the box connector and even separation of the connector from the PCB to which it is soldered. To address this problem with box connectors, the free ends or edges of the spring fingers are frequently provided with upwardly facing funnel-like receptacles arranged to receive a wedge-shaped member. When the wedge-shaped member is pressed towards the spring fingers it acts on the funnel shaped receptacles and separates the spring fingers from each other and from the seized wire to allow the wire to be withdrawn without damage to the wire or to the connector. Examples of such box connectors are shown in the following U.S. Pat. No. 9,484,639; DE102011015968 B4; U.S. Pat. No. 8,968,022 B2; US2017/0033499 A1; U.S. Pat. Nos. 9,472,871 B2; 9,548,564 B2.

In some cases, an integrated wedge push button arrangement is provided or an external tool needs to be used to separate the spring fingers, such as shown in U.S. Pat. No. 8,862,703 where a flat screwdriver edge needs to be used to separate the spring fingers or tines. See also KR101617330B1.

In U.S. Pat. No. 9,735,479 a single element wire to board connector terminal is disclosed in which one of the fingers or tines is provided with a portion to assist in the removal of an entrained central conductor. Furthermore, the terminal includes two elastic arm restricting portions that have inner surfaces that are arranged to abut against outer surfaces of the other hanging elastic arm making the hanging elastic arm deform only to a limited predetermined extent. This is done to avoid overstretching the hanging elastic arms beyond the yield point thereof to cause undesirable deformation of the hanging elastic arm. In one disclosed embodiment there is only one hanging elastic arm that has the elastic arm restricting portion while in a further embodiment both hanging elastic arms are formed with elastic arm restricting portions. However, the restricting portions determine the extent to which the hanging elastic arms can move outwardly, this potentially creating a problem in releasing especially larger diameter wires. The lower the gauge or the larger the diameter of the wires that are captured within the contact the less that the elastic arms can be further separated from each other and the more difficult that it is to break contact between the hanging elastic arms and the wire captured thereby. The connector terminal, therefore, has a built inherent limitation on the sizes of the wires that can be received therein and easily or efficiently released.

SUMMARY OF THE INVENTION

In order to overcome the drawbacks or disadvantages in known box type SMT receptacles or connectors it is a primary object of the invention to provide an electrical receptacle or connector terminal design that allows for easy and convenient release of a captured wire received therein independently of the diameter or gauge of the wire.

It is another object of the invention to provide a box receptacle as in the previous object that includes release tabs that can be manually actuated, or actuated with any tool such as a tweezer, tong, pincer or plier, to separate the spring fingers or contact tines retaining a captured wire independently of the size or gauge of the wire.

It is still another object of the invention to provide a box receptacle as aforementioned that can be inexpensively manufactured by stamping and coining a sheet metal material.

It is yet another object of the invention to provide receptacle of the type under discussion that is versatile and can be surface mounted on a printed circuit board (PCB) for wire entry both horizontally along the PCB as well as through-the-board or through-the-hole (TTH) entry or from above entry in a direction normal to the PCB.

It is a further object of the invention to provide a box receptacle that can capture wires between two spring fingers or contact tines and be quickly and conveniently released by manual application of squeezing force on the edges of surfaces situated generally above the spring fingers or contact tines that provide unhampered expanding movements of the fingers or tines independently of the diameter or gauge of the wire received within the box receptacle.

It is still a further object of the invention to provide a surface mount box receptacle as in the previous objects with releasing tabs attached to the spring fingers or contact tines that can be freely manually moved from positions proximate to the axis of the connector to positions beyond a receiving envelope of the connector that defines the limiting size of a wire that can be received therein.

In order to achieve the above and other objects that will become evident to those skilled in the art, the surface mount wire receptacle or connector in accordance to the invention comprises a generally elongate flat base suitable for surface mounting on a printed circuit board that defines a connector axis. A generally cylindrical enclosure projects from an upstream end of the base open in directions parallel to the axis and having parallel spaced side wall portions or supports offset from the axis. A pair of resilient spring fingers or contact tines extend from the side wall portions inwardly towards the axis to position free ends of the spring fingers in close proximity to each other at a point downstream of the cylindrical enclosure. An actuating tab is provided on each spring finger to form cantilevers extending across the axis and beyond a cooperating spring finger and having a free edge accessible to a user for application of generally opposing inwardly directed forces towards the axis to separate the free ends of the spring fingers when the actuating tabs are squeezed inwardly towards each other. The resilient spring finger free ends are movable between relaxed positions forming a gap between the free ends and extended positions in which a wire of diameter greater than the dimension of the gap can be frictionally engaged and captured by the free ends. When the tabs are squeezed inwardly this increases the spacing between the free ends a distance greater than the diameter of the captured wire. The actuating tabs are mounted outside a receiving envelope of the cylindrical enclosure and can move independently of the positions of the resilient fingers to clear the resilient fingers relative to any wire having a diameter receivable within the receiving envelope of the box receptacle.

BRIEF DESCRIPTION OF THE DRAWINGS

Those skilled in the art will appreciate the improvements and advantages that derive from the present invention upon reading the following detailed description, claims, and drawings, in which:

DETAILED DESCRIPTION

Figure 1:
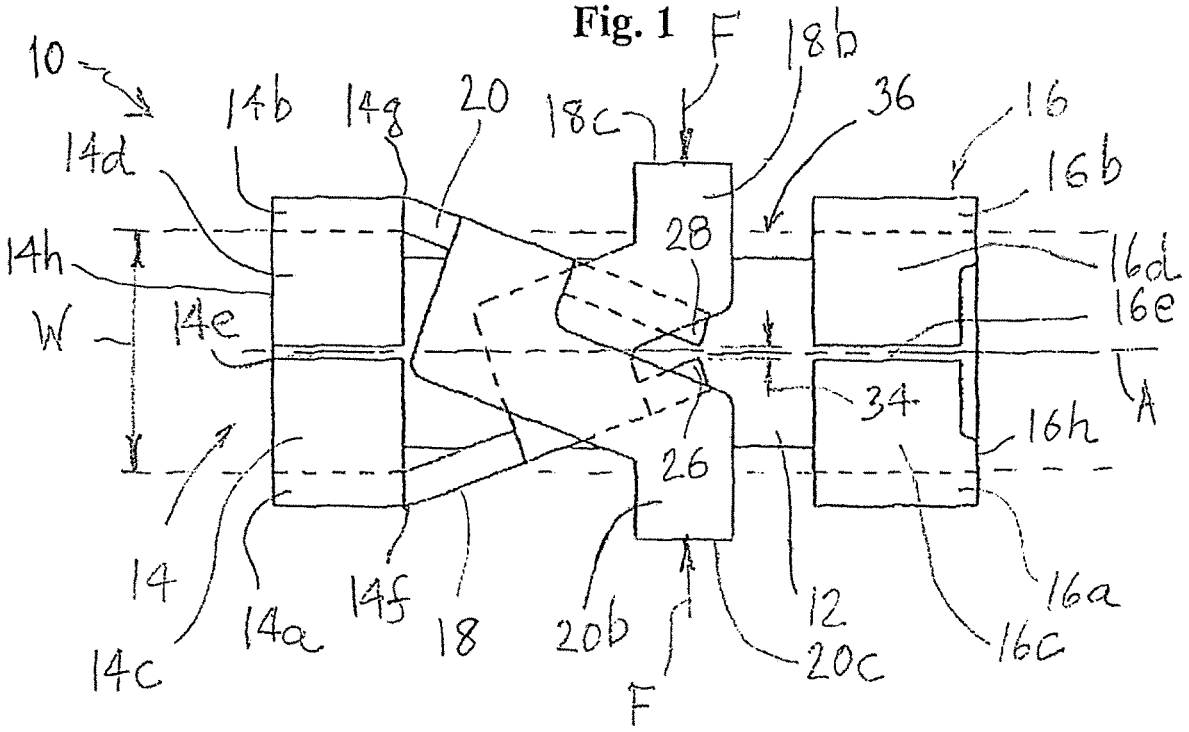
FIG. 1 is a top plan view of a surface mount box wire receptacle or electrical contact in accordance with the invention shown in a relaxed or normal condition prior to insertion of a wire.

Referring now specifically to the figures, in which identical or similar parts are designated by the same reference numerals throughout, and first referring to FIG. 1, a surface mount box receptacle or connector with release tabs in accordance with the invention is generally designated by the reference numeral 10.

Receptacle 10 is provided with a generally elongate base 12 extending along an axis A of the receptacle. Insertion of a wire is generally through a first upstream cylindrical enclosure 14. For purposes of this application the term "cylindrical" is defined as any three-dimensional enclosure generally defining an axis and having substantially uniform cross-sections along the axis.

Figure 4:
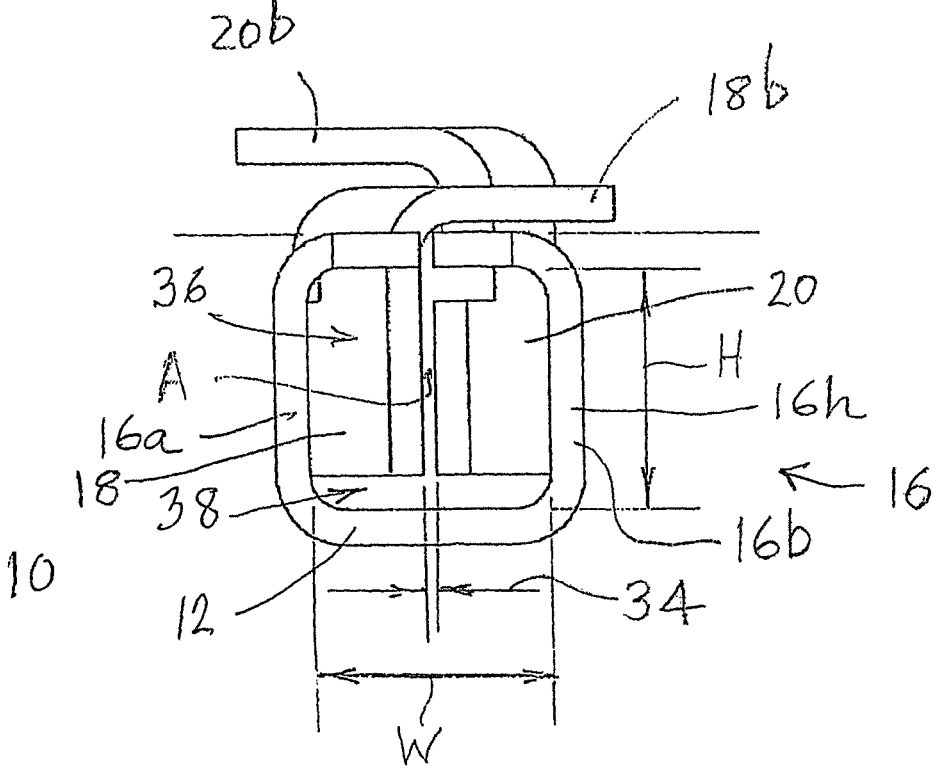
FIG. 4 is an end elevational view of the box connector shown in FIGS. 1 and 2.

As best shown in FIG. 4, the cylindrical enclosure 14 has a generally rectangular cross section with an internal height H and an internal width W. These dimensions define an envelope of the wire receiving space and the maximum diameter (W or H) of the wire that can be received and captured by the receptacle. Enclosure 14 includes side walls 14*a*, 14*b* and top wall portions 14*c*, 14*d* that are generally co-planer and form a gap or clearance 14*e*. The upstream facing surfaces of the side walls 14*a*, 14*b*, base 12 and top wall portions 14*c* and 14*d* of the upstream cylindrical enclosure 14 together form an upstream edge or surface 14*h* arranged in a plane generally normal to the axis A. Normally, a similarly configured cylindrical enclosure or receptacle 16 is also provided at the downstream or other longitudinal or opposing end of the base 12 that includes side walls 16*a*, 16*b*, top wall portions 16*c* and 16*d* and a clearance or gap 16*e*. A similar downstream edge or surface 16*h* is formed at the downstream end of the downstream cylindrical enclosure 16. The shapes and dimensions of the two cylindrical enclosures or "boxes" are generally the same and are coextensive in relation to the axis A and to each other.

Extending from the side walls 14*a*, 14*b* of the downstream enclosure 14 are leaf springs, spring fingers or contact tines 18, 20, respectively, that converge from the side walls 14*a*, 14*b* inwardly towards the center of the receptacle 10 to form a gap 34 as is customary with such box connectors. The spring fingers 18, 20 are, therefore, formed as cantilever springs and assume normal or relaxed positions shown in FIGS. 1 and 3. All of the aforementioned parts of the box receptacle are formed by precision stamping and coining from a single sheet of suitable metal sheet material, such as CDA 510 phosphor bronze, tempered and finished over with a layer of copper.

The spring fingers or contact tines 18, 20 have fixed ends 14*f*, 14*g* (FIG. 1), respectively, and free ends 26, 28 that have ends 30, 32 (FIG. 3) that can engage a wire to frictionally capture it when the wire diameter is greater than the dimension of the gap 34 when the fingers are in their normal relaxed positions. The internal surfaces of the box enclosures 14, 16 define a wire receiving envelope 36 (FIG. 4) the dimensions H and W of which determine the maximum size or gauge of wire that can be received within the receptacle. In the embodiment shown the dimensions H and W are substantially equal so that the cross-sections are generally square. The gap 34 is preferably provided to avoid contact between the free ends 30, 32 to ensure that the spring fingers are fully exposed and plated over their entire surface areas.

Figure 2:
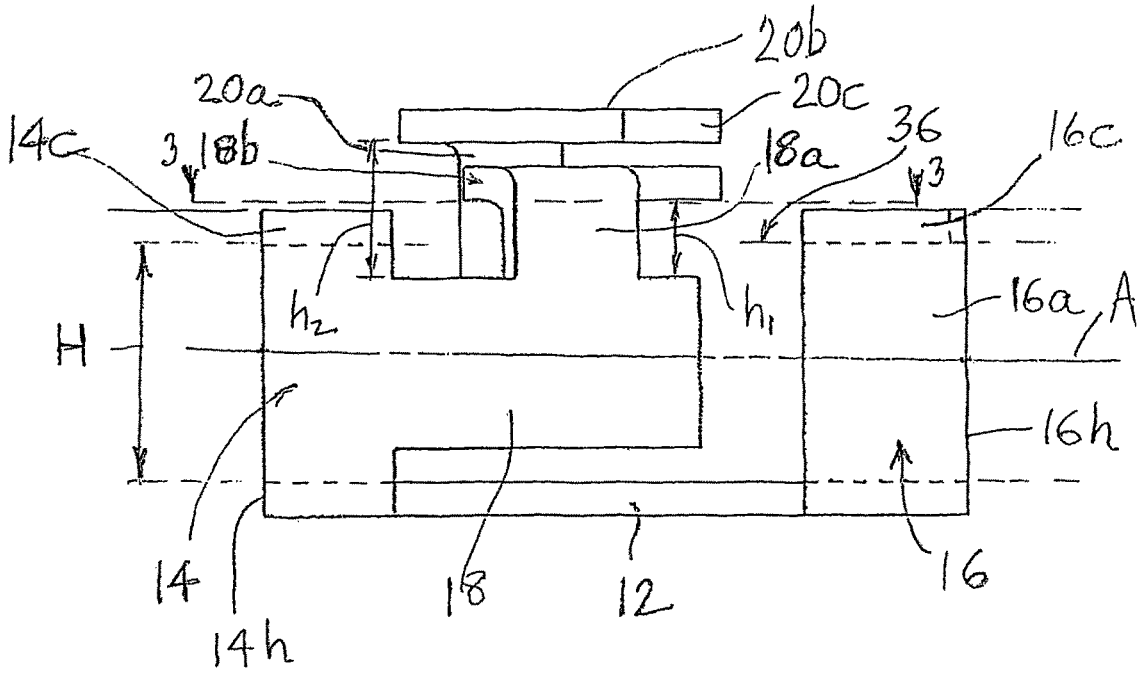
FIG. 2 is a side elevational view of the box connector shown in FIG. 1.
Figure 3:
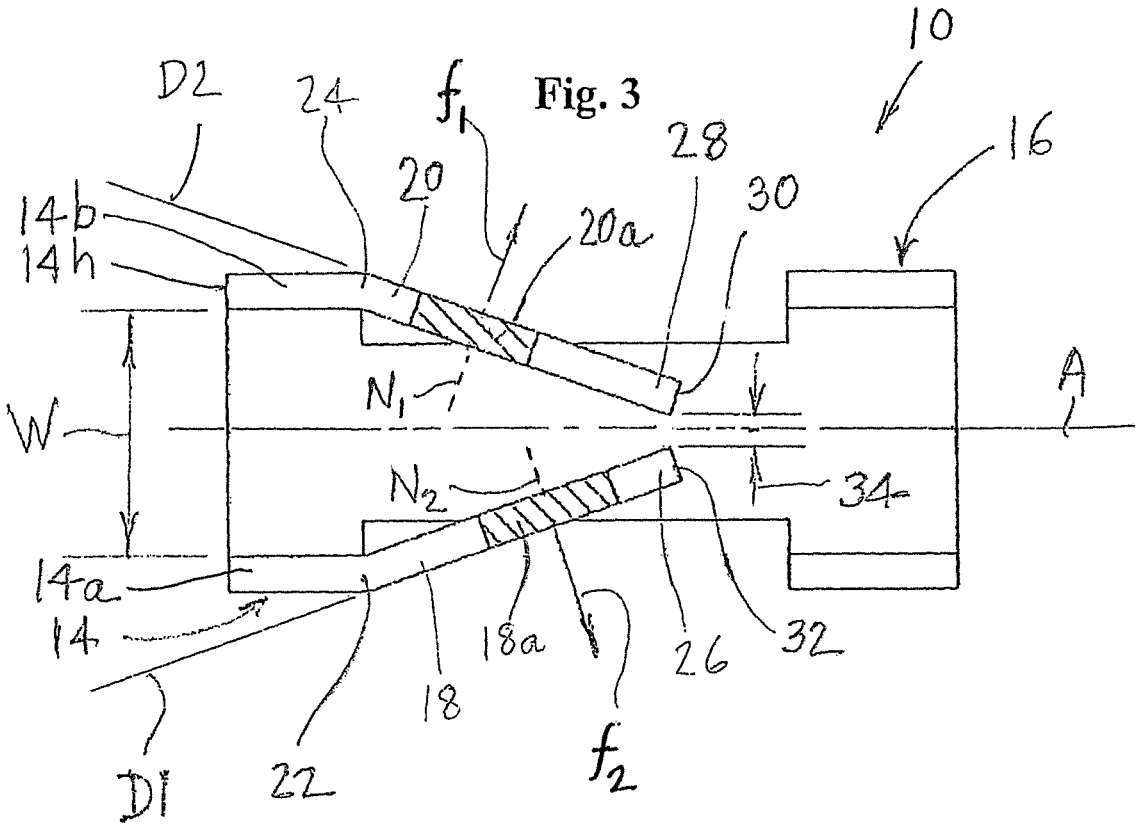
FIG. 3 is a top plan sectional view of the box connector shown in FIG. 2, taken along line 3-3.

An important feature of the invention is that each of the spring fingers 18, 20 is provided with extensions 18*a*, 20*a*, respectively, that extend or project from intermediate points of associated spring fingers 18, 20 between the fixed and free ends thereof (FIGS. 2 and 3). The extensions 18*a*, 20*a* have different lengths or dimensions $h_1$ $h_2$ extending from the respective spring fingers to vertically offset generally S or Z shaped actuating tabs 18*b*, 20*b* in planes generally parallel to the plane of the base 12. Actuating tab 18*b* has an edge 18*c* and the actuating tab 20*b* has an edge 20*c*. While the orientations of these edges 18*c*, 20*c* is not critical they are preferably generally parallel to each other and generally parallel to the axis A in the relaxed condition of the spring fingers 18, 20 to facilitate manual squeezing action by a user by application by forces F as shown in FIG. 1. Squeezing or compressive forces F can be applied by a user's fingers or, for small sized receptacles, by using tweezers or any other tool that can effectively engage the edges 18*c*, 20*c* and that can generate outwardly-directed forces $f_1$, $f_2$ as suggested in FIG. 3. It is clear that application of such forces $f_1$, $f_2$ will tend to separate the free ends 26, 28 of the spring fingers 18, 20 from each other, resiliently flexing them about fixed ends or points 14*f*, 14*g* to increase the size of the gap 34 between the free ends 26, 28 and facilitate insertion of especially higher gauge or finer, less stiff wires. This is illustrated, for example, in FIG. 3 where forces $f_1$, $f_2$ are normal along directions $N_1$, $N_2$ to the initial directions D1, D2 of the spring fingers to shift or spread them in response to application of the external forces F. For larger diameter, stiffer wires these can be inserted without manual deflection of the actuating tabs 18*b*, 20*b*. However, depending on the biasing forces applied to the captured wire by the spring fingers 18, 20 in most cases external forces F will need to be applied to release the wire without damaging the same.

It is an important feature of the invention that the release tabs 18*b*, 20*b* can move freely in response to the application of forces F without restriction irrespective of the diameter of the captured wire. Therefore, even for large diameter wires, approaching the dimensions of the receiving envelope 36, the actuating tabs 18*b*, 20*b* can still be actuated to further separate the spring fingers 18, 20 to move them into any desired positions within, coextensively with or beyond the receiving envelope 36 depending on the degree of flexing or extension that the spring fingers need to move to release a captured wire between the ends 30, 32. Thus, even when the captured wire has a diameter equal, for example, to W or H the release levers or tabs 18*b*, 20*b* can separate the free ends 26, 28 beyond the receiving envelope 36 to allow release of a captured wire with ease, convenience and without damage to the wire, the box receptacle or the PCB.

FIGS. 5-8 illustrate the same box receptacle 10 in different mounting modes.

Figure 5:
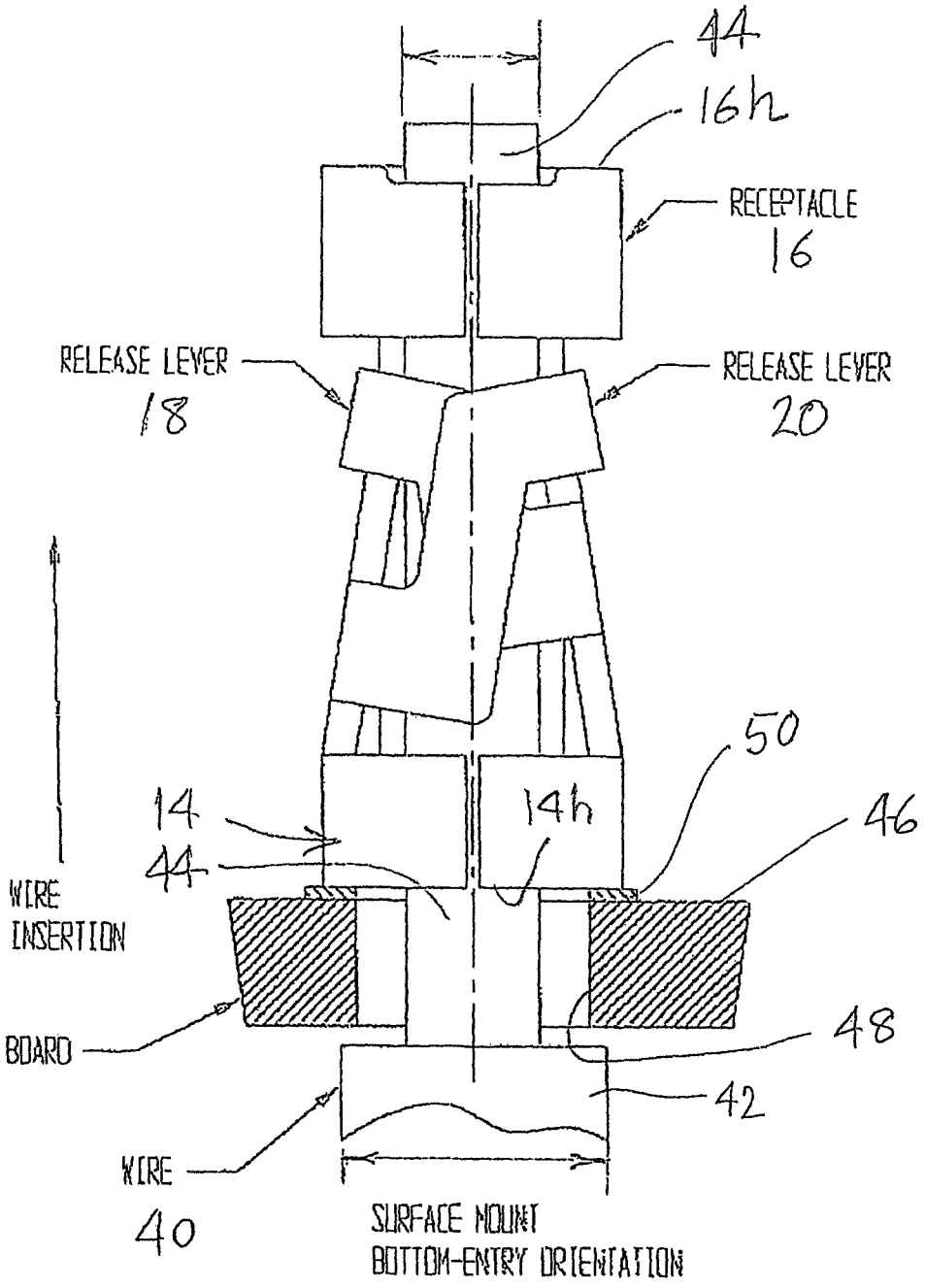
FIG. 5 is a top plan view of the box connector similar to FIG. 1, shown when the connector is mounted at a longitudinal end thereof on a printed circuit board with a wire captured therein after bottom entry through a hole in the PCB.
Figure 6:
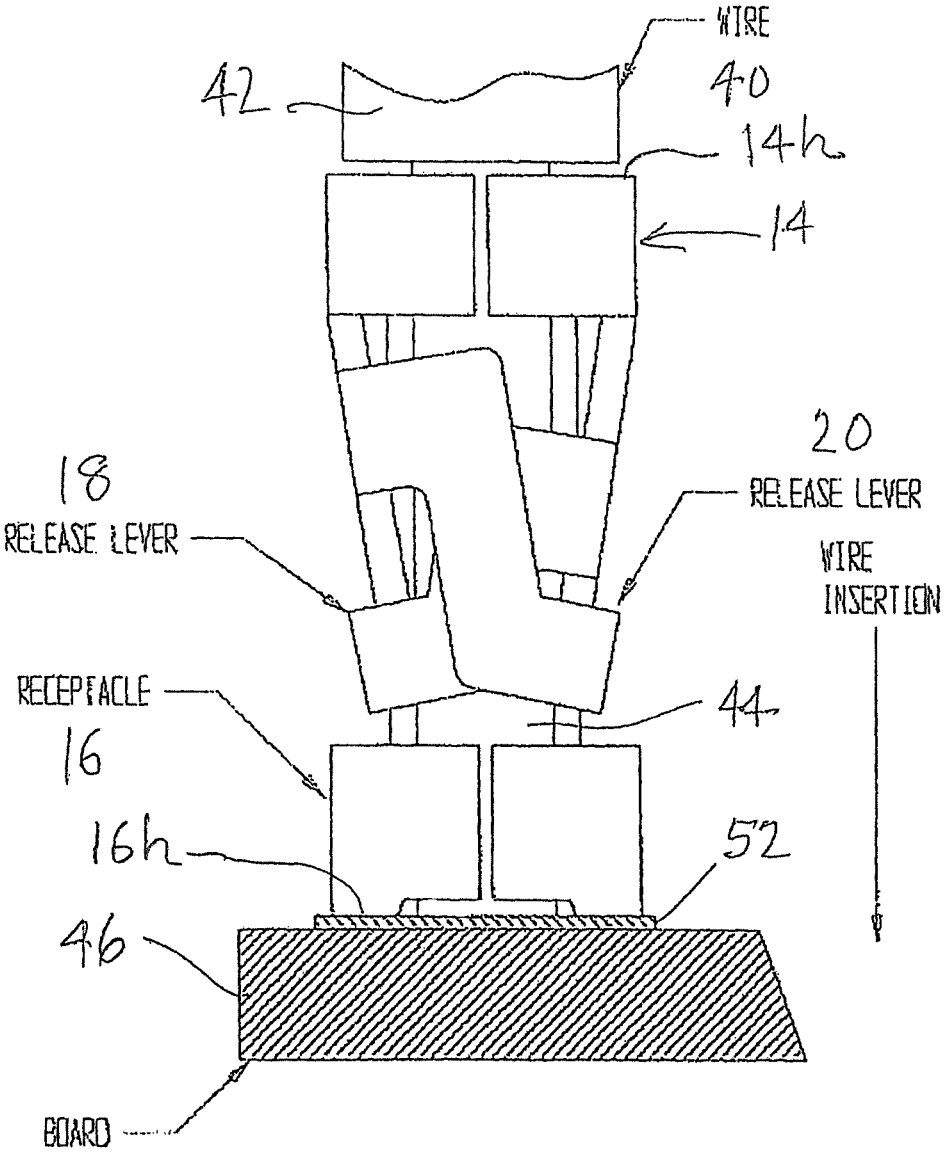
FIG. 6 is similar to FIG. 5, but showing the box connector inverted and mounted on a PCB with top entry therein.
Figure 7:
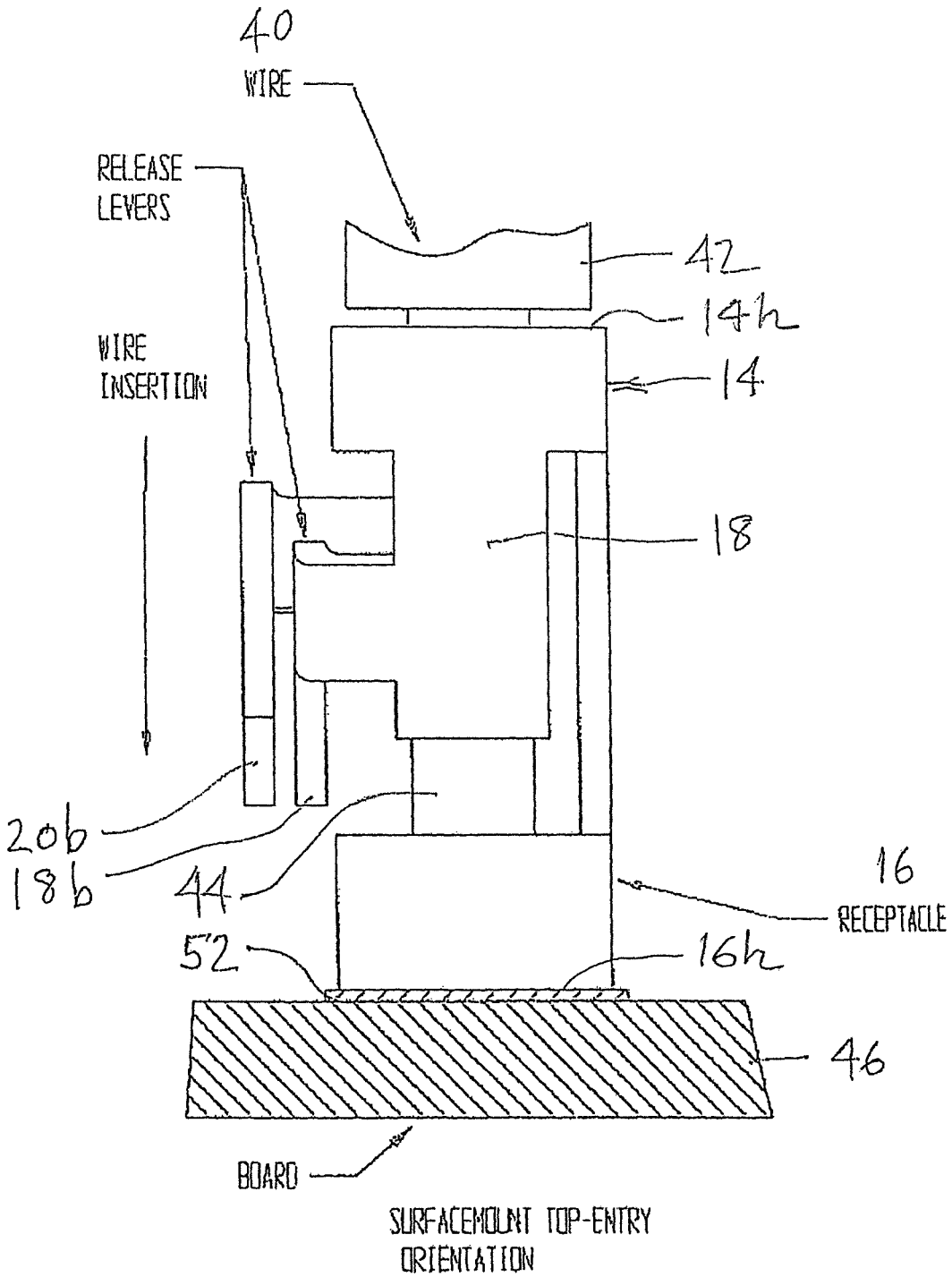
FIG. 7 is a side elevational view of the top entry orientation mounting arrangement shown in FIG. 6.

In FIGS. 5-7 the receptacle or connector 10 is shown mounted vertically in relation to the PCB 46. In FIG. 5, for example, the wire 40 having insulation 42 shows the bare wire 44 entering into the box receptacle through a hole 48 (TTH) in the PCB 46. In this case, the land or pad 50 on the PCB is also provided with a suitable hole to allow bottom entry of the wire into the receptacle.

FIGS. 6 and 7 illustrate vertical mounting to allow top-entry of the wire 40. In this case, the land 52 on which the box receptacle is mounted, does not require the TTH hole 48 in the board.

Figure 8:
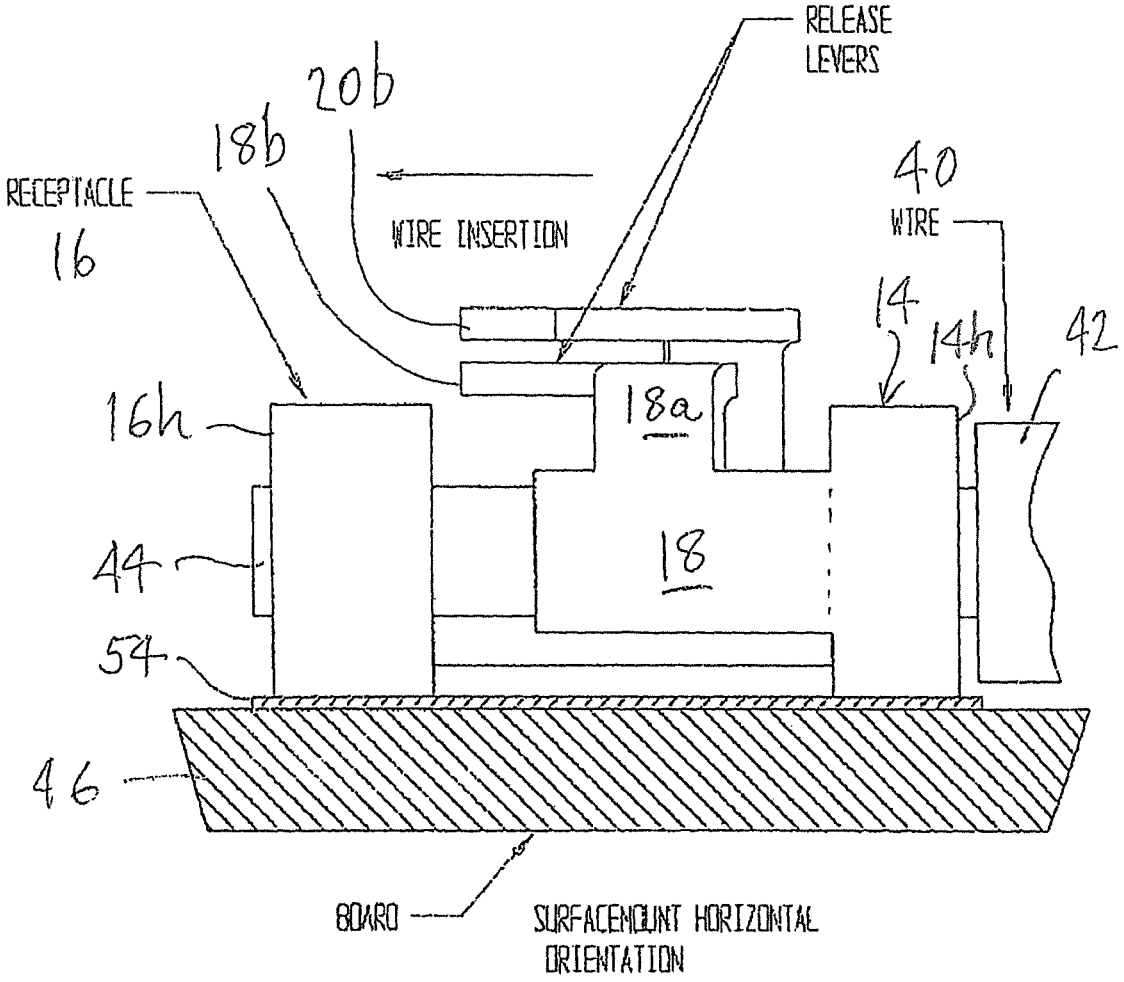
FIG. 8 is similar to FIG. 7 but showing the receptacle horizontally mounted on a PCB with a wire captured within the box receptacle.

In FIG. 8, the box receptacle is mounted horizontally in relation to the PCB 46 for insertion of the wire 40 in a direction generally parallel to the surface of the PCB as opposed to perpendicular entry in relation to the PCB. In all of these mounting modes, the operation of the box receptacle is identical. In each case, the edges 18*c*, 20*c* of the release tabs 18*b*, 20*b* can be squeezed towards each other to apply forces F as suggested in FIG. 1. The forces F separate the free ends 26, 28 of spring fingers or contact tines as may be necessary depending on the size or gauge of the wire to release the same without any interference or restrictions from any other portions of the box receptacle.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A surface mount wire receptacle or connector comprises: a generally elongate flat base suitable for surface mounting on a printed circuit board that defines a connector axis; spaced generally parallel supports extending from said flat base to either side of said connector axis at a leading or upstream end of said base; a pair of resilient spring fingers or contact tines having free ends that extend from said supports inwardly towards said connector axis to position said free ends of said spring fingers in close proximity to each other at a point downstream of said supports; and an actuating tab provided on each spring finger to form cantilevers extending across said axis and beyond a cooperating spring finger and having a free edge accessible to a user for application of generally opposing inwardly directed forces towards said axis to separate said free ends of said spring fingers when said actuating tabs are squeezed inwardly towards each other, said resilient spring finger free ends being movable between relaxed positions forming a gap between the free ends and extended positions in which a wire of diameter greater than the dimension of said gap can be frictionally engaged and captured between said free ends, said actuating tabs on said pair of spring fingers being arranged in different parallel planes so that said actuating tabs can move relative to each other even when they overlap, whereby when said actuating tabs are squeezed inwardly towards said axis this increases the spacing between said free ends a distance greater than the diameter of the captured wire, said free edges of actuating tabs being mounted outside a receiving envelope defined by a spacing between said supports and can move independently of the positions of said resilient fingers to clear said resilient fingers relative to any wire having a diameter receivable between said supports of the receptacle.

2. The receptacle or connector as defined in claim 1, wherein said generally parallel supports form side walls of an upstream generally cylindrical enclosure having open ends in the direction of said axis.

3. The A receptacle or connector as defined in claim 2, wherein said generally cylindrical enclosure defines generally uniform rectangular cross-sections in planes normal to said axis.

4. The receptacle or connector as defined in claim 2, further comprising a generally cylindrical enclosure at a downstream end of the base.

5. The receptacle or connector as defined in claim 4, wherein said cylindrical enclosure at said downstream end is provided with a downstream edge arranged in a plane normal to said axis, said downstream edge being two dimensional and suitable for vertical mounting to a land on a printed circuit board (PCB) to orient said connector axis in a direction normal to the PCB.

6. The receptacle or connector as defined in claim 5, wherein said downstream edge is substantially rectangular for mounting on a rectangular land.

7. The receptacle or connector as defined in claim 5, in combination with a printed circuit board provided with a through-hole surrounded by a cylindrical land generally corresponding to the cylindrical shape of said downstream edge for vertical mounting of the connector on the PCB to provide for insertion or bottom entry of a wire into the connector.

8. The receptacle or connector as defined in claim 4, wherein said cylindrical enclosures at said upstream and downstream ends are generally similarly dimensioned and coextensive with each other along said axis.

9. The receptacle or connector as defined in claim 2, wherein said upstream cylindrical enclosure is provided at an upstream end with a upstream edge arranged in a plane normal to said axis, said upstream edge being two dimensional and suitable for vertical mounting to a land on a printed circuit board (PCB) to orient said connector axis in a direction normal to the PCB.

10. The receptacle or connector as defined in claim 9, wherein said upstream edge is substantially rectangular for mounting on a rectangular land.

11. The receptacle or connector as defined in claim 9, in combination with a PCB provided with a through-hole surrounded by a land generally corresponding to the cylindrical shape of said upstream edge for vertical mounting of the connector on the PCB to provide for through-the-hole (TTH) insertion or bottom entry of a wire into the connector.

12. The receptacle or connector as defined in claim 1, wherein said free edges of said actuating tabs are generally parallel to each other and to said axis.

13. The receptacle or connector as defined in claim 1, wherein the receptacle or connector is formed by stamping and coining from a single sheet of sheet metal.

14. The receptacle or connector as defined in claim 13, wherein said sheet metal material is CDA 510 phosphor bronze.

15. The receptacle or connector as defined in claim 14, wherein said sheet metal material is tempered and coated with a layer of copper.

16. The receptacle or connector as defined in claim 1, wherein said actuating tabs are generally S or Z shaped.

17. The receptacle or connector as defined in claim 1, wherein said actuating tabs are generally offset from each other in relation to said base to allow free movements of said actuating tabs independently and without interference of each other.

18. The receptacle or connector as defined in claim 1, in combination with a printed circuit board provided with a through-hole surrounded by a cylindrical land generally corresponding to the cylindrical shape of said upstream edge for vertical mounting of the connector on the PCB to provide for insertion or bottom entry of a wire into the connector.

19. A method of forming a surface mount wire receptacle or connector comprises the steps of stamping a blank from spring tempered phosphorous bronze; and coining said blank to form a receptacle or connector comprising a generally elongate flat base suitable for surface mounting on a printed circuit board that defines a connector axis; spaced generally parallel supports extending from said flat base to either side of said connector axis at a leading or upstream end of said base; a pair of resilient spring fingers or contact tines having free ends that extend from said supports inwardly towards said connector axis to position said free ends of said spring fingers in close proximity to each other at a point downstream of said supports; an actuating tab provided on each spring finger to form cantilevers extending across said axis and beyond a cooperating spring finger and having a free edge accessible to a user for application of generally opposing inwardly directed forces towards said axis to separate said free ends of said spring fingers when said actuating tabs are squeezed inwardly towards each other, said resilient spring finger free ends being movable between relaxed positions forming a gap between the free ends and extended positions in which a wire of diameter greater than the dimension of said gap can be frictionally engaged and captured between said free ends, said actuating tabs on said pair of spring fingers being arranged in different parallel planes so that said actuating tabs can more relative to each other even when they overlap, whereby when said actuating tabs are squeezed inwardly towards said axis this increases the spacing between said free ends a distance greater than the diameter of the captured wire, said free edges of actuating tabs being mounted outside a receiving envelope defined by a spacing between said supports and can move independently of the positions of said resilient fingers to clear said resilient fingers relative to any wire having a diameter receivable between said supports of the receptacle.

20. A surface mount wire receptacle or connector comprises: a generally elongate flat base suitable for surface mounting on a printed circuit board that defines a connector axis; spaced generally parallel supports extending from said flat base to either side of said connector axis at a leading or upstream end of said base; a pair of resilient spring fingers or contact tines having free ends that extend from said supports inwardly towards said connector axis to position said free ends of said spring fingers in close proximity to each other at a point downstream of said supports; and an actuating tab provided on each spring finger to form cantilevers extending across said axis and beyond a cooperating spring finger and having a free edge accessible to a user for application of generally opposing inwardly directed forces towards said axis to separate said free ends of said spring fingers when said actuating tabs are squeezed inwardly towards each other, said resilient spring finger free ends being movable between relaxed positions forming a gap between the free ends and extended positions in which a wire of diameter greater than the dimension of said gap can be frictionally engaged and captured between said free ends, said free edges on said actuating tabs being substantially parallel to each other in said relaxed positions of said spring fingers to facilitate squeezing of said actuating tabs by application of substantially coextensive but opposite forces applied to said free edges of said actuating tabs, whereby when said actuating tabs are squeezed inwardly towards said axis this increases the spacing between said free ends a distance greater than the diameter of the captured wire, said free edges of said actuating tabs being mounted outside a receiving envelope defined by a spacing between said supports and can move independently of the positions of said resilient fingers to clear said resilient fingers relative to any wire having a diameter receivable between said supports of the receptacle.

* * * * *